US005260689A

United States Patent [19]

Meyers et al.

[11] Patent Number: 5,260,689

[45] Date of Patent: Nov. 9, 1993

[54] DUAL-MODE SKI ALARM APPARATUS

[75] Inventors: Chip E. R. Meyers, Santa Monica; Frederick W. Schmidt, Redondo Beach, both of Calif.

[73] Assignee: Brio Corporation, Santa Monica, Calif.

[21] Appl. No.: 900,133

[22] Filed: Jun. 18, 1992

[51] Int. Cl.[5] ..... G08B 13/14; G08B 21/00

[52] U.S. Cl. ..... 340/571; 340/521; 340/540; 340/568

[58] Field of Search ..... 340/571, 568, 521, 540

[56] References Cited

U.S. PATENT DOCUMENTS

| | | | |
|---|---|---|---|
| 3,728,675 | 4/1973 | Horn et al. | 340/427 |
| 3,988,724 | 10/1976 | Anderson | 340/539 |
| 4,023,157 | 5/1977 | Miller | 340/571 |
| 4,190,828 | 2/1980 | Wolf | 340/571 |
| 4,279,433 | 7/1981 | Petaja | 280/605 |
| 4,535,322 | 4/1985 | Yeski | 340/571 |
| 4,603,328 | 7/1986 | Larson | 340/666 |
| 4,804,943 | 2/1989 | Soleimani | 340/539 |
| 4,833,456 | 5/1989 | Heller | 340/571 |
| 4,835,523 | 5/1989 | Pruett | 340/571 |
| 4,855,720 | 8/1989 | Donovan | 340/571 |
| 5,001,461 | 5/1991 | Vroom | 340/572 |

*Primary Examiner*—Glenn R. Swann, III

*Attorney, Agent, or Firm*—Thomas I. Rozsa; Dong Chen

[57] ABSTRACT

The present invention is a dual-mode alarm apparatus for sports equipment. The two modes of the alarm apparatus are a first motion detect mode and a second separation detect mode. In the first motion detect mode, the alarm can be triggered when the device is moved from a set initial position which could be any orientation. In the second separation detect mode, the alarm can be triggered by the disconnection of a tether cord that changes the position of a tether switch, to help the user to locate his sporting equipment. The alarm fits in a compact housing to fit neatly on the sporting equipment, with an accessible key switch and a flashing LED to indicate the system is armed. The electronic circuitry of the alarm apparatus is an effective and efficient combination of functional electronic components which carry out a fixed sequence of electrical signal events, electronically responding to trigger events with a realistic sensitivity level of response, with a workable time span between the electrical signal events.

37 Claims, 2 Drawing Sheets

60
55
5
50
30
40
20
10
15
25

10
5
35

10
45
5

20
+V
SN1
B
C1
R1
I1
I2
D1
300
105

+V
N4
166
170
162
I1
I2
f2
N3
164
160

+V
105
INITIALI-ZATION CIRCUIT
RLFB
MSFB2
MSFB1
150
SOUNDER LOGIC
160
170
SOUND DRIVER
140
PULSE CAP-TURE NET-WORK
RESET LOGIC
110
COUNTER
R
CLK
C6
C7
C11
100
FLIP FLOP ARRAY
AI-1
AI-2
AI-3
AI-4
MOTION SENSOR
300
130
120
210
BATTERY SWITCH
180
TETHER SWITCH
190
CLOCK GENERATOR
f1
f2
f3
200
205

DUAL-MODE SKI ALARM APPARATUS

BACKGROUND OF THE INVENTION

Field of the Invention

This invention relates to the field of alarm apparatus. Specifically, the present invention is related to the field of dual-mode alarm apparatus for flat sporting equipment such as skis and snowboards. The two modes of the alarm are: in the first mode, the alarm detects motion upon a key switch enabling action; or in the second mode, the alarm can be triggered by the disconnection of a tether switch between the user and the flat sporting equipment, to help the user to find his flat sporting equipment if it is lost in the snow.

Description of the Prior Art

Ski alarms have been discovered in the prior art. However, the inventor is not aware of any prior art which provides the combination of the present invention's unique features.

The following 12 patents are the closest prior art of which the inventors are aware.

1. U.S. Pat. No. 5,001,461 issued to Vroom et al. (hereafter the "Vroom Patent") on Mar. 19, 1991 for "Ski Equipment Theft Alarm".
2. U.S. Pat. No. 4,835,523 issued to Pruett (hereafter the "Pruett Patent") on May 30, 1989 for "Ski Beeper".
3. U.S. Pat. No. 4,833,456, issued to Heller (hereafter the "Heller Patent") on May 23, 1989 for "Ski Security Device".
4. U.S. Pat. No. 4,603,328 issued to Larson (hereafter the "Larson Patent") on Jul. 29, 1986 for "Ski Tracking Alarm".
5. U.S. Pat. No. 4,855,720 issued to Donovan (hereafter the "Donovan Patent") on Aug. 8, 1989 for "Anti-Theft Ski Alarm".
6. U.S. Pat. No. 4,279,433 issued to Petaja (hereafter the "Petaja Patent") on Jul. 21, 1981 for "Emergency Locator Beacon for Skis".
7. U.S. Pat. No. 3,988,724 issued to Anderson (hereafter the "Anderson Patent") on Oct. 26, 1976 for "Theft Alarm".
8. U.S. Pat. No. 3,728,675 issued to Horn et al. (hereafter the "Horn Patent") on Apr. 17, 1973 for "Cycle Alarm Apparatus".
9. U.S. Pat. No. 4,023,157 issued to Miller (hereafter the "Miller Patent") on May 10, 1977 for "Theft Alarm for Portable Articles".
10. U.S. Pat. No. 4,535,322 issued to Yeski (hereafter the "Yeski Patent") on Aug. 13, 1985 for "Ski Theft Alarm and Runaway Ski Locator".
11. U.S. Pat. No. 4,804,943 issued to Soleimani (hereafter the "Soleimani Patent") on Feb. 14, 1989 for "Remotely Controlled Briefcase Alarm".
12. U.S. Pat. No. 4,190,828 issued to Wolf (hereafter the "Wolf Patent") on Feb. 26, 1980 for "Movement Sensitive Anti-Theft Alarm".

The Vroom Patent discloses a system for protecting skis from theft. The Vroom Patent utilizes a motion sensor connected to a timer which ensures that the duration of motion is significant enough to signal the alarm. A code generator and a transmitter sends a unique signal over radio frequency to the person holding the receiver, to notify the person of movement of the skis. The Vroom Patent device mounts within the ski bindings.

The Vroom Patent is significantly different from the present invention, partially because of the location of the mounting, which is in the ski binding and not on the surface of the ski alone, and the absence of a signaling capability in the event that the ski is lost and buried in the snow. Furthermore, a light emitting diode (LED) display for the surface of the device is not disclosed, therefore, the packaging aspect of the present invention is also different from the Vroom Patent. Finally, the motion detector in the Vroom Patent is only vaguely mentioned as a motion sensor switch and is not defined in detail as a mercury activated switch which can signal the change in position from any activated orientation.

The Pruett Patent discloses a ski beeper which assists a skier in locating a ski which detaches from the ski boots. The activator is mounted on the plate of the ski boot binding and not directly on the ski as in the present invention. In addition, the Pruett Patent does not have the motion detector capability. The Pruett Patent is basically a mechanically switched device which becomes active when the boot is disengaged from the binding. The circuitry in the Pruett Patent is therefore not in the same category as the circuit element combinations in the present invention.

The Heller Patent discloses a ski security device which can sense movement of the device by means of a conductive tether which generates an alarm activated signal to a sounding device upon movement of the skis. A digital code is used to lock and unlock the alarm device through communication with a microprocessor. The Heller Patent also differs substantially from the present invention because of the lack of varying modes of operation, such as the mode for tracking lost skis. In addition, the present invention does not utilize a microprocessor for realizing the objectives of the invention. The present invention utilizes passive and active electronic components in conjunction with switches, including a mercury position sensor switch. In addition, the present invention has the capability of being comprised in an alternative embodiment with means for transmitting and receiving signals activating and deactivating various switches in each device.

The Larson Patent discloses a ski tracking alarm which has an audible alarm contained in a housing which attaches to the ski. The alarm is sounded when the ski boot is disengaged from the ski binding.

The Donovan Patent discloses an anti theft ski alarm which involves a coded sequence of digits to activate and deactivate the alarm. The alarm is set to prevent theft by triggering a sound alarm when the skis are moved by an unauthorized person.

The Petaja Patent discloses an emergency locator beacon for skis which assists in the retrieval of lost skis in thick snow by means of a strobe light which is activated by a sensor that senses separation of the ski equipment and the skier.

The Anderson Patent discloses a theft alarm which has a transmitter that produces a radio frequency signal to indicate that the device is being tampered with. The signal is detected in a receiver which changes the position of a magnetically activated switch.

The Horn Patent discloses a cycle alarm which can transmit signals to a remote receiver. The cycle alarm has an angle sensing mercury switch which can detect tilting or vibrations.

The Miller Patent discloses a theft alarm for portable articles which detects motion. The alarm could be triggered by a movement which is short in duration, in which case, the alarm will shut off soon afterward.

Sustained movement will cause the alarm to emit a continued, pulsating alarm sound.

The Yeski Patent discloses a ski theft alarm and runaway ski locator which can sound an audible signal when the cable which forms a part of a locking device is cut, or when the ski is detached from the boot.

The Soleimani Patent discloses a remotely controlled briefcase alarm which utilizes a receiver coupled to a siren which is mounted in a briefcase and which can be activated by a remote transmitter. The concept is to activate the alarm siren in the event of an unauthorized person running off with the briefcase.

The Wolf Patent discloses a movement sensitive anti-theft alarm which triggers the alarm circuit by means of a photosensitive sensor. The triggering is sent to a delaying circuit which is operably connected to an arming means. A light detecting means at the triggering portion of the circuit is adjusted to an effective sensitivity to a light source for detecting movement or vibrations which indicate the theft of the article being moved.

Although the above discussed prior art patents have disclosed many different types of alarm apparatus, each one of the prior art patents, except the Yeski Patent serves either as on anti-theft apparatus which only detects the motion of the ski, or as a lost-tracking apparatus which only detects the disengagement of the ski. Although the Yeski Patent can be used for both anti-theft and ski-tracking purposes, it did not use a motion sensor for the anti-theft purpose, but instead used the same cable and clip assembly for both ski-tracking and locking (anti-theft) purposes. This is understandable because a motion alarm must work when the ski is in stationary condition, but a disengagement alarm must work when the ski is in moving condition. None of the prior art patents has disclosed an alarm apparatus which combines these two alarms into one single unit. Therefore, it is highly desirable to have such a dual-mode ski alarm apparatus.

SUMMARY OF THE PRESENT INVENTION

The present invention is a unique dual-mode alarm apparatus for flat sporting equipment such as skis and snowboards. In general, the uniqueness of the present invention includes: the packaging of the device, which physically mounts to the surface of the ski and has an aerodynamic outer surface, with colorful graphics and a light emitting diode (LED) indicator display which signals that the device is armed; the dual-mode of operation, with a motion sensor mode that detects motion after arming the system in any orientation, and the tether mode which detects a change in the position of a tether switch; and the design electronics which utilizes an efficient arrangement of active and passive circuit elements to perform a specific timed sequence of events.

Skis which become detached from the ski boot coupling are sometimes lost in high snow drifts under certain skiing conditions. Skis are usually designed to easily disengage the ski boot connections on varying levels of stress to prevent injury to the skiers due to inflexible connections to ski boots which could, under highly dynamic motions, become caught when the skier falls, thereby resulting in violent stresses to the skier. For this reason skis are designed to disconnect easily from the boots. However, the disconnection could result in the loss of a ski, or an extensive search to find the ski which could be buried in a snow drift. In the past, manufacturers of skis and ski boots have used flexible connector cords to hold the skis, but this also could bind up during falls and also become annoying to attach and detach. To overcome these problems, the present invention utilizes an alarm system which could be activated by pulling a cord out of the alarm system in the event of a fall or a loss of a ski.

In addition to the capability of having an alerting alarm for finding lost skis, the present invention can be armed to sense motion. The motion sensor is derived from a very unique mercury switch arrangement which can be set from any orientation. Once set, the alarm is armed, and any movement or motion will alert the ski owner by means of the alarm signal.

The alarm system can be activated by mechanical or key switches. An alternative embodiment of the present invention has additionally been envisioned as having a hand held ski finder and alarm set remote device to switch the alarm into any of the various alarm states with a wireless device which can activate the invention at a distance. A variety of different wireless device activation modes could be utilized in conjunction with the present invention, such as: arming and disarming the alarm switches into any of the alarm modes; and, activation and deactivation of the loud alerting sound emitted by the alarm. Another alternative embodiment of the hand held ski finder and alarm set remote device could signal the ski owner who is out of range of the sound alarm at the skis, to take note of the fact that the skis have been moved. This alternative embodiment would include a wireless communication between the ski motion detector circuit and either a sound alarm on the hand held device or an LED display or both.

Therefore, the uniqueness of the present invention includes: the appealing packaging, with an LED display and aerodynamic streamlined shape which mounts onto the ski; the capability of setting armed modes to detect either motion of the skis in the first mode to prevent theft, or the audible signal to locate a ski in the second mode which could be useful in the event of falling and losing one or more skis; the means by which the circuit activates the alarm in various modes, with the mechanically set switches and mercury activated position switch; the combination of active and passive circuit elements to accomplish the electronic objectives of the device and their interconnection; and the capability of the alternative embodiments which can send and receive activating signals over a wireless channel.

The device has the capability of being set to three basic alarm states: powered up but not armed; armed but not triggered; and triggered where an alerting alarm sound is activated. The device can be triggered for two primary modes of operation: first, where the device is unexpectedly moved; and second, where the device disengages from a nylon tether cord which pulls out if the ski is lost while skiing. In addition, the alarm can be triggered if an attempt is made to remove the battery. Finally, the circuit includes low power complementary metal oxide semiconductor (CMOS) circuitry in an effective and unique arrangement of circuit elements.

The circuit elements in the present invention include: a Schmitt NAND gate; several D-type Flip-Flops; a binary ripple counter with clock generator; a piezoelectric transducer and driver circuit; a mercury switch which can be activated from any orientation; and various rate control time constant circuits with various functions, including: the rate control of the charging and discharging of potentials at the input of logic elements, the generation of a waveshaped initialization pulse and a chirp pulse by means of a rapidly transitioning voltage fed into a time delay network.

An alternative embodiment of the present invention is envisioned in a ski finder and alarm set remote which can receive and transmit various digitally coded alarm pulse signals through wireless means.

The system organization of the present invention involves several components. Each of the components has inputs and outputs (I/O) in the form of electronic signals.

The function of the counter unit is to systematically set forth a timed sequence of events. The counter's set of inputs include: a reset input and a clock input. The counter's basic output is a binary count. If the reset input is asserted, the binary count is brought to 0 and if the reset input is held in a sustained manner, the count is prohibited from proceeding. When the count is proceeding, the time interval between each count is determined by the period of the clock generator input. The counter block represents a single integrated circuit (IC) which is usually available in a sealed package.

The clock generator unit provides the timings for three blocks of the system. The active component in the clock generator unit is the clock generator which has an internal clock and also has several output pins tuned to the internal clock frequency. Different variations of the fundamental clock period can be obtained by tapping specific output pins. In this manner, different divisions of the clock fundamental frequency can be obtained. The clock generator unit provides three system frequency outputs: a constant frequency which is input to the counter; a warbling signal which is input to the sounder logic, which warbles a constant frequency by introducing an error signal which intermittently shifts the frequency of the constant frequency signal slightly; and a free running light emitting diode (LED) signal which provides a periodic pulse to the LED driver circuit that briefly flashes the LED, then pauses while the LED is dark for a longer duration of time so that the power dissipated by the LED is minor.

There is an initialization channel which carries an initialization pulse after turning on of the main power key-on switch. The initialization channel carries a pulse which has been waveshaped by the implementation of the time delay network, with a Schmitt trigger wired with inverter logic (a first input connected to a two-input NAND gate where the second input is wired to a high signal, acts to invert the first input). The key switch provides an abrupt step function which is introduced to the waveshaping circuitry and is thereby cleaned to have sharply transitioning edges and constant levels of high and low voltage. The initialization pulse on the initialization channel almost simultaneously initializes the counter via the reset logic block and the Flip-Flop array. The initialization of the counter is necessary because the counter must start a known start count, which in the present invention is a null output or 0. The initialization of the Flip-Flop array must be performed because a Flip-Flop memory element maintains an output based on initial conditions and prior events. In the absence of an initialization procedure, the present state of a Flip-Flop is usually not ascertainable.

The Flip-Flop array receives instructions in the form of discrete 1 and 0 from the counter. The counter continues to advance the count until it is inhibited by the reset logic. After the initialization is complete, a signal is received from the counter, and the Flip-Flop array dispatches a signal through the feedback channel precluding the continuance of the count. The Flip-Flop array is hardware wired to respond in a predetermined manner to an anticipated series of asynchronous signal instructions, keeping in view specific initial conditions. The signal instructions which are input to the Flip-Flop array by the counter include: the initialization count which has a start count with null outputs; the signal which indicates that initialization is complete, upon which the alarm is waiting for a motion event to trigger the alarm; and a signal which indicates that the alarm has been ringing for approximately 2 minutes, upon which the alarm is placed back in the active state where it is again waiting for a motion event to trigger the alarm. The tether switch signal is also input to the Flip-Flop array, informing the Flip-Flop array of the removal of the tether once the tether mode is established. The initial conditions which directly impact the Flip-Flop array are specified as: first, the position of the key-on switch, which provides the initialization pulse along the initialization channel; and the initial position of the tether switch at key-on.

The feedback channel is a branching network which has the capability of: testing the continuity of the motion sensor; and can supply a signal to the reset logic which restrains the counter. The counter is restrained through the assertion of the counter reset pin. The feedback channel is divided into three basic branches. The first branch is directed to the reset logic. The second and third branches are directed to the motion sensor and is wired so that these two branches could source and sink the current which could, potentially, be conducted through the motion sensor.

The motion sensor, enabled by its link to the feedback channel, sends a continuity signal to a pulse capture network which prevents spikes from falsely triggering the input to the reset logic. The pulse capture network smooths the signal by sending the capricious, erratic, high frequency components of the signal to ground, so that only the more sluggish, deliberate, lower frequency signals are passed by the pulse capture network. The reset logic must receive a generally sustained continuity signal for a duration specified by the timer. The reason for the requirement of a sustained continuity signal is to verify the legitimacy of the motion detector's continuity signal, so that a slight jarring to the motion detector would not set off an unintentional, annoying alarm condition.

The reset logic feedback branch feeds into a differentiating, high pass network at the reset logic feedback input, which passes the transitioning upward voltage from the output of the Flip-Flop network, at the 2 minute counter signal, into a pulse which resets the counter.

The sounder logic of the present invention receives inputs from: first, the Flip-Flop array which could directly trigger the alarm or cause a brief chirp through the transformation of a transitioning signal into a pulse, which is passed through a differential network; second, the tether switch position, which sets the mode of the alarm and is an important consideration of the sounder logic's criteria for enabling the alarm; and third, the clock generator which provides a warbling signal which is gated by the sounder logic. Once the logical conditions for the sounder alarm are met, the clock generator is gated to the driver circuit which provides the power requirements to sound the piezoelectric speaker. The driver circuit includes a push-pull power amplifier for highly matched gain of both a negative power surge and a positive power surge, feeding into a transformer circuit which modifies the voltage across a voltage swing sensitive piezoelectric crystal that propagates a high vibratory output at the four kilohertz input frequency of the clock generator.

It has been discovered, according to the present invention, that an alarm circuit could be designed to operate in two modes of operation, including a first motion detector mode and a second tether mode, where each of the modes can be switched on by turning on a key switch, depending on the condition of another switch in the tether aperture which closes when the tether is inserted. Once the condition of the tether switch is set, turning the key switch will set the mode of the alarm apparatus: when the tether switch is on, turning on the key switch will cause the circuit to operate in the tether mode; when the tether switch is off, turning on the key switch will cause the circuit to operate in the motion detector mode.

It has been further discovered, according to the present invention, that, in either of the two modes of operation, turning on the key switch will impress a waveshaped initialization pulse on the initialization channel, which will establish expected initial conditions to the memory elements and also set the initial condition of the counter, so that a predetermined sequence of time dependent events will occur in succession.

It has been additionally discovered, according to the present invention, that an effective and efficient system organization should include: a counter with an output connected to the input of a Flip-Flop array; a feedback channel from the output of the Flip-Flop array which is channeled to a motion sensor by two paths of the Flip-Flop array output and by another path which is in turn channeled to the reset logic; where the motion sensor signal is submitted to the reset logic by way of a pulse capture network; and where the reset logic, based on the inputs to the reset logic, decides whether to reset the counter. The combination of the output of the Flip-Flop array and the position of the tether switch provides an input to the sounder logic which determines whether the conditions are appropriate to drive the alarm sound.

It has been further discovered, according to the present invention, that a freely running clock generator could provide the timings for: the clock of the counter; a sounding alarm, which receives a warbling tone due to a slight shift in frequency of the clock generator input; and the periodic flash of a light emitting diode (LED) which is lighted for a brief instant with a dark period of longer duration to reduce power consumption.

It has also been discovered, according to the present invention, that a sounding alarm could be configured by driving a logic array with a clock generator, where the logic array drives a push-pull power amplifying circuit. The power amplifying circuit drives a transformer which has an output driving a piezoelectric crystal to a vibratory state. The input to the logic array enables the sounding alarm if asserted. In addition, a momentary chirp could be realized through a differential network path at the output of the Flip-Flop array.

It is therefore an object of the present invention to provide an alarm circuit which is designed to operate in two modes of operation: a first motion detector mode and a second tether mode. Each of the modes are switched on with a turn of a key switch. The mode is determined by another switch which is positioned by placing the tether into the tether aperture.

It is a further object of the present invention, that, in either of the two modes of operation, turning on the key switch will impress a waveshaped initialization pulse on the initialization channel, which will establish anticipated initial conditions to the memory elements and will also set the initial condition of the counter, so that a predetermined sequence of time dependent events will occur in succession to ready the alarm into an active state.

It is an additional object of the present invention, to provide an effective and efficient system organization which includes: a counter with an output connected to the input of a Flip-Flop array; a feedback channel originating from the outputs of the Flip-Flop array which is received at a sink and source path through the motion sensor, and is also received at another path at the input to the reset logic; where the motion sensor signal is submitted to the reset logic by way of a pulse capture network; and where the reset logic, based on the inputs to the reset logic, is positioned so that the output of the reset logic could provide a signal which could reset the counter. The Flip-Flop array output and the position of the tether switch are the input criteria of the sounder logic in determining whether driver circuitry should be enabled to sound the alarm.

It is a further object of the present invention, to provide a freely running clock generator which could provide the timings for: the clock of the counter; a sounding alarm, which receives a warbling tone due to a slight shift in frequency of the clock generator input; and the periodic flash of a light emitting diode (LED) which is lighted for a brief instant with a dark period of longer duration to reduce power consumption.

It is also an object of the present invention, to provide a sounding alarm that is configured as a sounder logic array which is synchronized to a clock generator, where the logic array and clock generator drives a push-pull power amplifying circuit, and where the power amplifying circuit drives a transformer which has an output impressing a modified signal across a piezoelectric speaker. The inputs to the logic array determine the enabling of the sounding alarm.

In the preferred embodiment of the present invention, the alarm system is turned on by an external key switch and will assume one of two modes of operation based on the inclusion of the tether. The alarm system signals the user of an alarm by means of a loud warbling tone. The system needs a turn of the key switch to remove the alarm conditions.

In an alternative embodiment, the alarm system mounted on the flat sporting equipment is turned on and shut off by means of a hand held device which includes a four-position switch transmitter, where three of the four switch positions are set to transmit digital code signals. The signals are converted to frequencies at an active oscillator circuit along a propagating means which fans over the wireless channel to stimulate active tank circuits tuned to a plurality of frequency bands that are received at the mounted alarm system, which are received and shifted by shift registers to be compared to a known code, where the result of a match could (depending on the known code received): first, provide an initialization pulse; second, disable the alarm; and third, enable the alarm. There would be a transmitter and receiver in the hand held device, and a transmitter and receiver in the alarm system which is mounted on the flat sporting equipment. The transmitter and receiver would be linked through a digital signal processing channel where the digital codes are sent along a wireless channel then converted back to digital codes where they are received.

In another alternative embodiment, the wireless channel range could be extended so that a person who is carrying the hand held device could be alerted by another party.

In still another alternative embodiment, the wireless channel could be tuned to the operating frequencies of a repeater network.

The present invention is not limited to only skis and snowboards, but there are several flat sporting equipment embodiments which could be used with the present invention.

In general, the uniqueness of the present invention is concentrated in the circuit operation and the exceptional implementation of active and passive circuit elements. Resistor and capacitor networks are specifically designed to propagate interesting signal characteristics and remove ancillary noise from the signals, in order to adapt the analog levels to a cleaned digital network, and to take convert sharp digital transitions to a widened pulse (as shown in the chirp). Schmitt logic elements perform analog to digital interfacing functions to implement waveshaping. The counter operation is suspended and reset through a feedback path which is taken from the output of a Flip-Flop array which also receives instructions from the counter. The counter and Flip-Flop array are initialized by a digitally waveshaped pulse resulting from the differentially processed voltage transition caused by the power start of the turn key switch. In the motion detection mode, a source and sink continuity branch of the feedback loop includes a response from the motion sensor, which could enable the alarm triggering if the timing conditions provided by the reset logic are present. Another branch of the feedback loop provides a second alarm enabling condition to the reset logic. In the tether switch mode, the physical removal of a tether changes the orientation of a switch that directly triggers the alarm after initialization.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
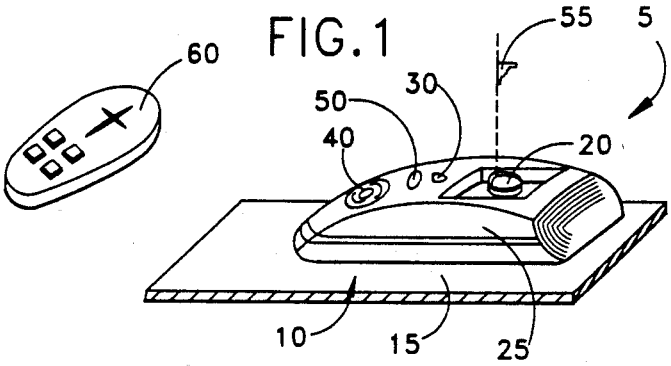
FIG. 1 is a perspective view of the dual-mode alarm apparatus, shown on the surface of flat sporting equipment.
Figure 1A:
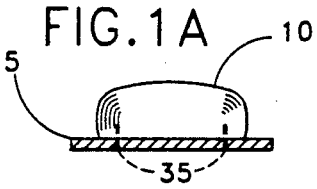
FIG. 1A is an end view of the dual-mode alarm apparatus, shown attached to the surface of flat sporting equipment by screw means.
Figure 1B:
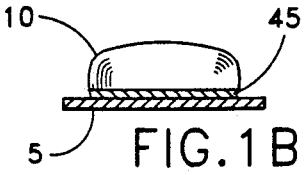
FIG. 1B is also an end view of the dual-mode alarm apparatus, shown attached to the surface of flat sporting equipment by adhesive means.

Referring to FIG. 1, there is a perspective view of the preferred embodiment of the present invention dual-mode alarm apparatus 10. The dual-mode alarm apparatus 10 is supported on flat sporting equipment 5, such as skis or a snowboard. The dual-mode alarm apparatus 10 may be mounted to the sporting equipment 5 by standard mounting means such as screws or bolts 35 as shown in FIG. 1A, or adhesive materials such as double-sided adhesive tape 45 as shown in FIG. 1B. Other suitable mounting means may also be utilized. It is desirable that the mounting means is lockable or tamper-proof. It is also desirable that when a user wants to, the dual-mode alarm apparatus 10 may be removed from the sporting equipment 5 by utilizing appropriate tools.

Generally, the dual-mode alarm apparatus 10 is useful in any situation where sporting equipment could get lost, where the owner would benefit from an alert of the disconnection of a tether, or where the owner should be alerted that the equipment is being moved. In fact, the present invention could be useful in any situation where there is a need for a dual-mode alerting system which has a motion sensor mode, and in another mode, there is a signal that the position of another switch has changed. The circuit is very unique in that the initial position of the key switch determines the mode which the circuit operates from power on of the key switch 20. The key switch 20 may be turned on or off by a key 55, or by a hand held remote control device 60 which will be described in detail later.

The overall structural shape of the dual-mode alarm apparatus 10 is configured to fit the design electronics into a compact, generally aerodynamic style, outer housing 15. The outer housing 15 of the dual-mode alarm apparatus 10 supports the external aspects of the communicating devices such as the vent apertures of the sound propagator 40 and the cavity for the LED blinker 30. The outer housing 15 of the dual-mode alarm apparatus 10 also supports an upper cavity 25, where the key switch 20 is placed. The upper cavity 25 can be covered by a flat lid. There is a tether switch 50 also located in an accessible location of the outer housing 15. The outer housing 15 of the dual-mode alarm apparatus 10 also supports the design electronics inside the packaging, with an outer surface accessibility to the battery which could be located at the interfacing surface to the flat sporting equipment 5. The battery cover also has a tamper switch which will be described in the analysis of the circuit.

There are two external switches which are available at the housing 15, the key switch 20 and the tether switch 50. The key switch 20 has two positions, key-on and key-off. The key-on position causes the alarm system to go into an active state, for either of the two modes: there is the motion detector mode, which alerts the user of the event that the flat sporting equipment 5 is being moved when it is unauthorized to do so; and the other mode is the tether mode, which sounds an alarm to notify the user of the location of the individual flat sporting equipment, in the event that the user should fall off and the equipment become lost or buried in the snow. The key-off removes power to the circuitry. In the absence of electrical power, none of the modes can become active.

Figure 2:
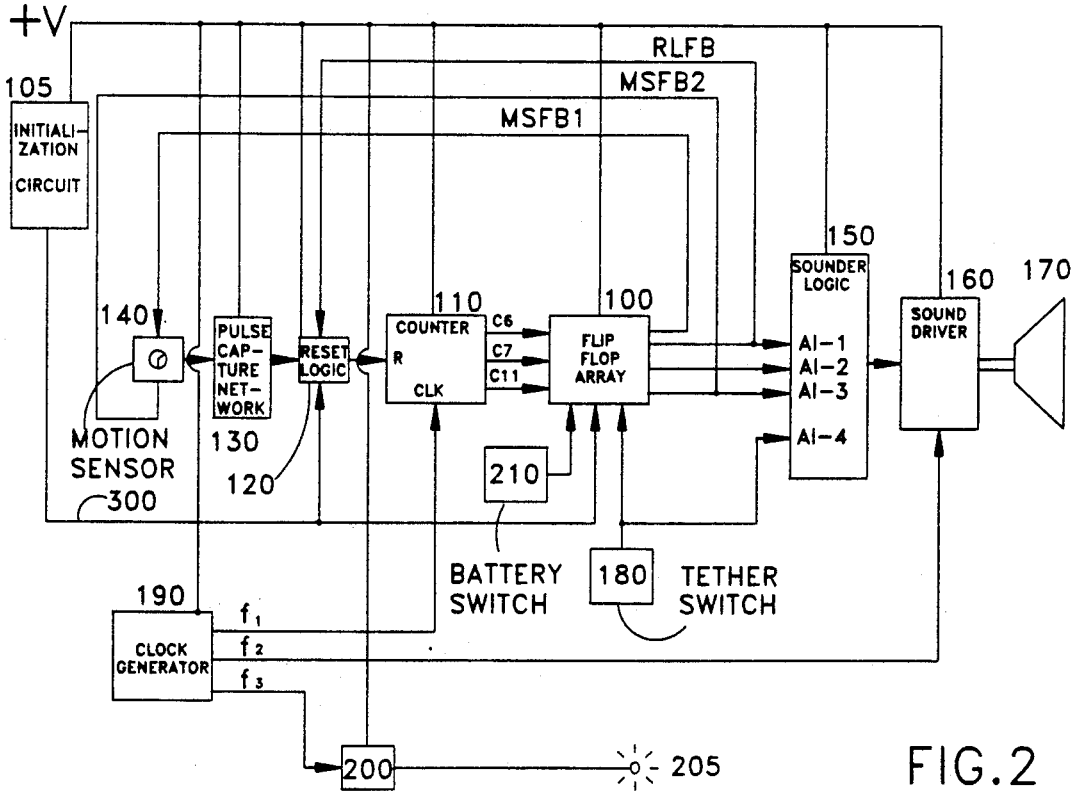
FIG. 2 is the organization of the functional blocks of the circuit.

Referring to block diagram circuit organization of FIG. 2, there is shown some of the principal parts of the circuit, showing the basic functions of the parts and the functional relationships. The entire circuit organization can be considered, at the broadest sense, as a system which has a time dependent response of outputs, to a set of inputs.

In the loop of the circuit organization, the motion sensor 140 is shown. There are three terminals to the motion sensor 140. Two of the terminals are at the ends of a conductive paths between the first motion sensor feedback path MSFB1 and the second motion sensor feedback path MSFB2. The conductive path is open circuit unless the motion sensor is moved. The motion sensor 140 utilizes an internal mercury switch which could cause the conductive path to be closed from any initial orientation. The third terminal of the motion sensor 140 is a motion sensor disposition output, which is the output of a voltage divider which is fed to the pulse capture network 130.

In another part of the circuit organization, there is the tether switch 180, which provides input to the Flip-Flop array 100 and the sounder logic 150. The tether switch 180 performs two functions. First, at initialization of the circuit, it sets the mode of the circuit into the motion sensor mode or the tether mode. Second, in the tether mode, the circuit can detect the change in position of the tether switch, which causes an alarm condition, that triggers the auditory alarm.

In the circuit organization, the clock generator 190 supplies periodic signals used for synchronization of the circuit. There are three output frequencies f1, f2, and f3 which are utilized by the circuit. These output frequencies f1, f2 and f3 determine the timing of the response.

The counter 110 receives counter frequency f1 from the clock generator 190. From the power-on condition of the circuit, the counter 110 receives a steady stream of periodic pulses, with a period of 65 milliseconds (msec.), from the clock generator 190. The counter 110 receives these periodic pulses at its CLK input pin, and in the absence of an asserted reset R pin, outputs the count of these pulses by asserting a binary count signal, of 1 and 0 at a binary count sequence, on its output pins C1, C2, . . . C12. In the present embodiment, only three of the output pins are utilized, representing timings (in a rough approximation) of 4 seconds, 8 seconds and 128 seconds (approximately 2 minutes). The counter output pins which represent the 4 seconds, 8 seconds and 2 minutes count are designated output counter pins C6, C7 and C11. To be more exact, the binary count corresponding to output counter pins C6, C7 and C11, with 12 digits for each binary number, are represented in Table I as follows:

TABLE I

Binary And Decimal Numbers Associated With The Count Of The Counter Output Pins

| | Binary Count | Decimal Count |
|---|---|---|
| C6: | 0000 0000 1000 0000 | 128 |
| C7: | 0000 0001 0000 0000 | 256 |
| C11: | 0001 0000 0000 0000 | 4096 |

Referring the Table I, in the binary count, the least significant figure, representing the most fleeting time interval is to the right of the binary count. Notice that for the assertion of counter output pin C6, the sixth digit from the least significant digit is a 1; similarly, for C7, the seventh digit from the end is a 1; and for C11, the eleventh digit from the least significant digit is a 1. Each higher denomination count pin signal represents a doubling of the count, so that once each higher count pin signal is achieved, there is a reiteration of the lower denominator pins according to a binary count sequence.

Referring to FIG. 2, the count of the counter output pins C6, C7 and C11 continues unless the reset signal at pin R is asserted which causes all of the outputs to be 0, and the count, if started again, will start from the lowest denomination pin from the reset signal at pin R condition. In the preferred embodiment, the clock generator 190 supplies a clock frequency f1 to the counter 110 by asserting one clock CLK signal every 65 msec.

Figure 6:
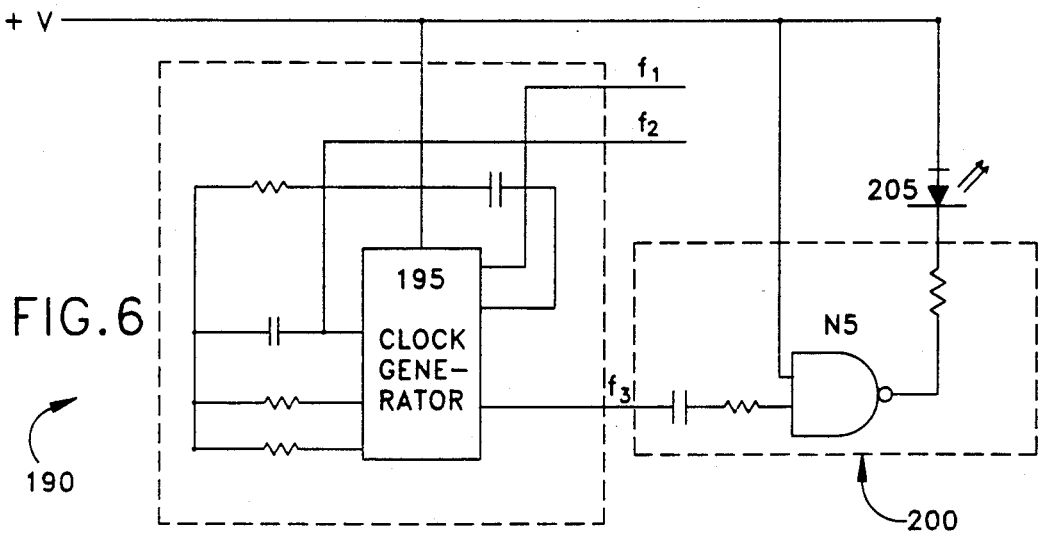
FIG. 6 is a circuit diagram of the clock generator and light emitting diode (LED) driver.

Referring to FIG. 6, there is shown a circuit diagram of the clock generator 190 and the frequencies f1, f2 and f3. The counter frequency f1, and the LED driver frequency f3 are taken directly from the clock generator integrated circuit (IC) chip 195. The warbler frequency f2, is obtained from a capacitively coupled network which utilizes an error signal every 0.25 second to alter the generally constant 4 kilo-Hertz (KHz) frequency from the clock generator IC 195.

Referring to FIG. 2 again, the clock generator 190 also supplies a 4 KHz frequency f2 to the sounder alarm driver 160. The frequency f2 includes an injected error signal to warble the alarm sounder with a slight change in frequency every quarter second. The sounder alarm driver 150 feeds into a piezoelectric crystal and horn 170, to create a loud auditory sound. In the present invention, any audible tone generating means could be used to emit the auditory signal.

Referring to FIG. 6 again, the clock generator 190 further provides a constant frequency strobe f3 to the light emitting diode (LED) driver 200 which drives the flashing LED 205. The LED 205 flashes for a brief moment (to reduce power consumption) every 2 seconds. The LED driver 200 inverts the LED driver frequency f3 to provide a conductive path for the voltage +V, across the series of the LED 205 and the LED driver 200. The flashing LED 205 can be any pulsating light signaling means. Aside from light emitting diodes, there are several types of liquid crystal displays which are often used for a multitude of light signals.

Referring again to FIG. 2, there is a Flip-Flop array 100 which receives input from the counter 110, the battery switch 210, the tether switch 180, and the initialization channel 300. The output of the Flip-Flop array 100 is forwarded to the sounder logic 150. There are several feedback paths which are taken from the output of the Flip-Flop array 100. There is the reset logic feedback RLFB, the first motion sensor feedback MSFB1 and the second motion sensor feedback MSFB2.

The Flip-Flop array 100 utilizes D-type Flip-Flops. The D-type Flip-Flops provide a memory of state conditions. The interconnections of these memory elements determine the output state changes based on the input of a specific set of input conditions. The prior state output conditions also influence the output state changes. The Flip-Flop array 100 can therefore be expected to establish a particular sequence of events which is dependent on the internal interconnection of the individual D-type Flip-Flops.

Figure 3:
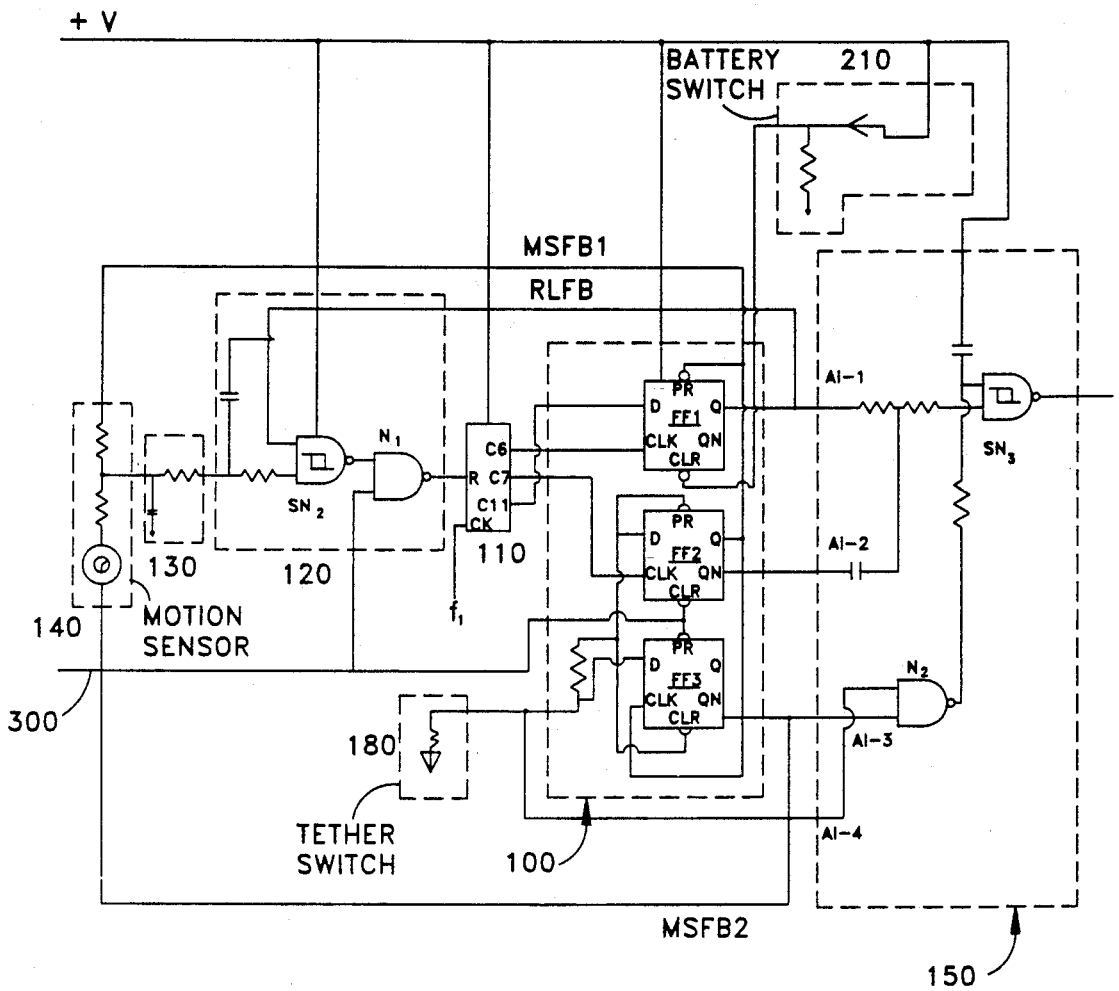
FIG. 3 is a detailed circuit organization of the main interconnections of the active and passive components in the circuit, including the Flip-Flop array.

Referring to the circuit diagram of FIG. 3, the interconnections of the Flip-Flop array 100 are shown. Each D-type Flip-Flop in the Flip-Flop array 100 has two outputs and four inputs. The two outputs are: the Q-output which is the present state output condition; and there is the QNOT-output (shown as QN in FIG. 3) which is simply the logical negation of the Q-output (shown as Q in FIG. 3). The inputs to the D-type Flip-Flops are: the D-input which appears at the Q-output after a clock cycle; the CLK-input which provides the signal for clocking the D-input forward, from the input to the output; the PRESET (marked PR in FIG. 2) input which, if asserted, overrides the present conditions and causes the Q-output to be 1; and the CLR-input which, if asserted, overrides the present conditions to cause the Q-output to be 0.

Referring to FIGS. 3 through 6, it can be seen that there are several NAND gate gates in the circuit, including the NAND gate gates integrated into the reset logic 120, the sounder logic 150 and the sounder driver 160. By way of example, in FIG. 3, the Schmitt NAND gate in the reset logic 120 is designated SN2 and there is another NAND gate in the reset logic designated N1. The logical NAND gate has a truth table which is the logical negation of the truth table for a logical AND function. The NAND gate truth table based on two inputs A, B is the following:

TABLE II

| Truth Table Based On A NAND B | | |
|---|---|---|
| A | B | A NAND B |
| 1 | 1 | 0 |
| 1 | 0 | 1 |
| 0 | 1 | 1 |
| 0 | 0 | 1 |

From the truth table of Table II, it can be seen that 1 and 1 are the only two combinations which cause the NAND-output to be 0; the following combinations, 1 and 0, 0 and 1, and 0 and 0, cause the output to be 1. When the A input is fixed to a 1, the B input is inverted at the output, and vice versa. This arrangement allows the NAND gate to be arranged as an inverter. The inverter arrangement is taken advantage of in several parts of the circuit.

A special case of the NAND gate in the Schmitt NAND gate, used in various locations in the circuit, including: the reset logic 120, the sounder logic 150 and at the power on of the initialization channel 300. The Schmitt NAND gate has a specific high/low trigger level which receives slowly transitioning analog high and analog low levels, and cleans the signals into sharply transitioning digital 1 and digital 0 signals.

The Schmitt NAND gate is used to accept generally wavering analog voltages, (high and low level, including noise) and to perform waveshaping of the input analog voltages into clean, definite, digital output signals of 1 and 0. A Schmitt NAND gate cleans the signal by only accepting input voltages at levels which are either higher than the high level of a deadband region, or lower than the low level of a deadband region. Voltages within the deadband region are not recognized. In this manner, clean analog to digital signal conversion is implemented.

The present circuit arrangement makes use of the time constant characteristics of various resistor and capacitor (RC) combinations. The RC combinations are utilized in functional arrangements to perform several purposes: to generate pulses from transitioning voltages; to filter high frequency or low frequency components from signals at various parts of the circuit; and, in general, for controlling timings by setting up the charging, holding of the charge and the discharging of a capacitor using resistors for throttling the current flow.

Referring to FIGS. 3 through 6, RC combinations are utilized in several functional circuit blocks, including: at the pulse capture network 130, at the reset logic 120, at the sounder logic 150, at the LED driver 200 and at the clock generator 190 and at the input to the initialization channel 300.

Figure 4:
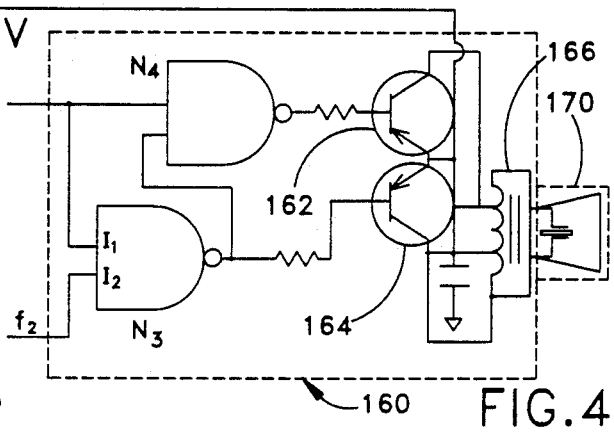
FIG. 4 is a circuit diagram of the sounder driver, piezoelectric crystal and horn.

Referring to FIG. 4, a pair of PNP transistors, 162 and 164 are driven by the NAND gate gates N3 and N4. The PNP transistors 162 and 164 are alternately biased-on and biased-off by the output of NAND gate gates N3 and N4. The PNP transistors 162 and 164 are utilized in the sounder driver 160 to provide a balanced current amplification about a grounded transformer tap point which is directly coupled to the collectors of the pair of PNP transistors, 162 and 164.

The transformer 166 modifies the applied voltage by a factor proportional to the ratio of turns of the coils. The output of the transformer 166 drives the piezo-electronic sounding device in the piezoelectric crystal and horn 170 by setting an oscillating voltage across the piezoelectric crystal which becomes mechanically strained due to the electric field. The mechanical strain produces vibratory energy for a strong acoustical response, especially at the 4 KHz center frequency of the input.

There are four switching elements which are used for setting the alarm states, and for triggering the alarm. Referring to FIG. 3, the first switching element is a motion sensor 140, which can detect motion after it is set up in any orientation. Upon motion detection, a mercury switch within the motion sensor 140 momentarily closes an open circuit which provides a conductive path between its terminals. The motion sensor 140 also has a voltage divider in its functional block so that when the motion sensor 140 is conducting, there will be a low voltage motion sensor disposition output at the junction input to the pulse capture network 130. The terminals of the motions sensor 140 have junctions at the feedback paths MSFB1 and MSFB2 stemming from the Flip-Flop array 100.

Figure 5:
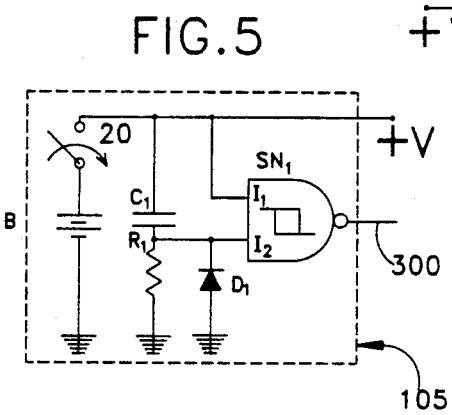
FIG. 5 is a circuit diagram of the initialization circuitry which waveshapes an initialization pulse.

Referring to FIGS. 5 and 2, there is also a second switching element which is a key switch 20 that provides a turn on step function signal at key-on, to be processed into an initialization pulse on the initialization channel 300. The initialization channel 300 carries an initialization pulse which sets the sequence of events in motion that precede the alarm enabled condition for the motion detector mode or the tether mode of operation.

Referring to FIGS. 2 and 3, there is also a third switching element which is a tether switch 180. When the tether is inserted at initialization, the circuit becomes operative in the tether mode. The tether insertion closes the tether switch 180. While the circuit is in the tether mode, the motion detector circuitry is inhibited from triggering the sound alarm.

Finally, there is a fourth switching element which is a battery door switch 210. The effect of the battery door switch 210 is that if the battery door is tampered with, the sound alarm is enabled.

The operation of the circuit is as follows. Referring to FIG. 5, there is shown an initialization circuit 105. The alarm is initialized by the turn of a key switch 20 which provides power to the circuit. Turning on the power, applies a step voltage to the time dependent series resistor and capacitor (RC) combination which is configured to pass high frequency signal components, such as the abrupt edge of the step voltage resulting from closing the key switch 20 to the battery B.

After a moment (where the duration is determined by the RC time constant of the circuit) the steady state direct current voltage subsequent to the leading edge of the step voltage does not pass through the capacitor and the capacitor acts like an open circuit. However, the abrupt edge of the step voltage does pass through the capacitor, where it appears as a momentary high signal pulse to the input at the junction to input I2 of the Schmitt NAND gate SN1. Such an arrangement is usually termed a time delay network because it exclusively responds to the transitioning part of the step voltage introduced to the RC combination. The resultant pulse at the input I2 of the Schmitt NAND gate SN1 remains at a high level for a time interval proportional to the RC time constant of the RC network comprised of capacitor C1 and resistor R1. The diode D1 provides a fast discharge path for node I2.

At the Schmitt NAND gate SN1, moments after the power on by the closing of key switch 20, the Schmitt NAND gate SN1 receives a brief, high pulse input at I2, while the input I1 of the Schmitt NAND gate SN1 is also receiving a high input (due to the direct connection to the battery voltage). These two inputs at I1 and I2 of the Schmitt NAND gate SN1 cause a cleaned initialization pulse to be output on the initialization channel 300.

The initialization pulse occurs only once, upon the power on caused by closing the key switch 20. The initialization pulse is the result of a very unique waveshaping technique established by the functional cooperation between active and passive components in an analog to digital conversion. The initialization pulse is critical to the sequential operation of the circuit because it places the state dependent elements into a known state immediately after power on.

Referring to FIG. 2, the initialization pulse appears on the initialization channel 300. The initialization pulse directly triggers a state change in two linked functional blocks along the initialization channel 300. The two linked functional blocks are the reset logic 120, and Flip-Flop array 100. The initialization pulse linked to the reset logic 120 causes a reset signal at pin R of the counter 110 which, in turn, establishes expected inputs for the Flip-Flop array 100. The initialization pulse linked to the Flip-Flop array 100, causes a generally immediately known initial state to the D-type Flip-Flops of the Flip-Flop array 100.

Upon receiving the reset signal at pin R of the counter 110, the counter 110 begins counting from its reset condition caused by the reset signal at pin R. There is a time constraint which delays the next sequence of events according to the clocked frequency f1 supplied by the clock generator 190.

Referring to FIG. 3, a detailed view of the circuit elements in selected functional blocks is shown. The signal propagation sequence involves timing events which occur at specific timings. The timing events include: the initialization, the start count, the alarm ready condition and the alarm triggered condition. The timing events are separated, in time, according to a binary count which is synchronized to the frequency of the clock generator 190.

The counter output pin C6 of the counter 110 is wired directly to the Flip-Flop array 100 at the CLK input of the first D-type Flip-Flop FF1, to accommodate the capability of signaling a count of 10000000 at the counter frequency f2, occurring approximately 4 seconds from the start of the count. The counter output pin C7 is wired directly to the CLK input of the second D-type Flip-Flop FF2, which is capable of signaling a count of 100000000, approximately 8 seconds from the start of the count. The counter output pin C11 is wired directly to the D-input of FF1, which could signal an event at a timing 1000010000000, approximately 2 minutes from the start of the count.

With the initialization pulse impressed along the initialization channel 300, the Flip-Flop array 100 is forced to a known state in the following manner. The initialization pulse places a 0 at the CLR pin of FF2, causing a reset signal, placing the Q-output of FF2 at a 0 state. The initialization pulse also places a 0 at the PR pin of the third D-type Flip-Flop FF3. A 0 at the PR pin causes a set signal, placing the Q-output of FF3 at an output of 1.

The initialization pulse also places a 0 at one of the inputs to a reset NAND gate N1 in the reset logic 120. The output of the reset NAND gate N1 is wired directly to the counter 110, at the reset signal at pin R. The reset NAND gate N1 has two inputs. The first input to the reset NAND gate N1 is wired to the initialization channel 300, and receives the initialization pulse. The second input to the reset NAND gate N1 is from the Schmitt NAND gate SN2.

The Schmitt NAND gate SN2 has two inputs. The first input is connected to reset logic feedback channel RLFB, a feedback path which originates at the Q-output of FF1. The second feedback input to Schmitt NAND gate SN2 originates from the motion sensor feedback channel one MSFB1. The MSFB1 channel logic level is obtained from the Q-output of FF2, which was reset by the initialization pulse to the known initial state of 0. Since the MSFB1 channel is logic level 0, the output of the motion sensor 140 is a low level, regardless of the continuity of the sensor or the level of the second motion sensor feedback channel 2 (MSFB2) because of the internal voltage divider in the motion sensor 140 which is biased toward transmitting a low level from the MSFB1 channel. The output of the motion sensor 140 is input to a pulse capture network 130 which is input to the Schmitt NAND gate SN2 of the reset logic 120 through a resistor at the input. Therefore, the low level at MSFB1 provides a determining signal to the Schmitt NAND gate SN2 which forces the output of the Schmitt NAND gate SN2 to be a 1. Since the output of Schmitt NAND gate SN2 is a 1, the reset NAND gate N1 has a second input of 1.

The initialization pulse on the initialization channel 300 causes the reset logic 120 to output a 1, onto the reset signal at pin R of the counter 110, from the reset NAND gate N1. The removal of the reset signal at pin R of the counter 110 causes the start of the count to begin.

There is an interaction between the counter 110 and the Flip-Flop array 100. In addition, there is an interaction between the Flip-Flop array 100 and the sounder logic 150. The sounder logic 150 has four inputs: first, the alarm-on input AI-1 which drives the N1 input to the alarm Schmitt NAND gate, and stems from the Q-output of FF1; second, there is the chirp input AI-2 which recognizes a transition from the QNOT-output of FF2, and widens the transition at the high pass network that the QNOT-output of FF2 faces; third, there is the 1-condition input AI-3 which is taken from the QNOT-output of FF3; and fourth, the switch-condition input AI-4, which is specifically dependent on the position of the tether switch 180.

The two latter inputs, the 1-condition input AI-3 and the switch condition input AI-4, are directed to a tether NAND gate N2. The tether NAND gate N2 will only be 0 if both of the inputs are 1. This condition should not occur when the switch is closed at 0 ground. The significance of the tether NAND gate N2 output, is that it is wired to second input of the alarm Schmitt NAND gate SN3 which could trigger the alarm sound if either of the inputs to the alarm Schmitt NAND gate SN3 are 0. Therefore, if the conditions of 1 and 1 are present at the input to the tether NAND gate N2, the alarm will sound.

In addition to the above conditions for the alarm to sound, there is a battery switch 210 which is wired to the CLR pin of FF1. If the switch loses continuity, the CLR pin drops to ground level, causing a 0 Q-output from FF1, to the alarm on input AI-1, which triggers the alarm.

In order to accurately describe the conditions of the timings which cause the system to operate, there must be an accounting of the conditions of the Flip-Flop array 100, at the moments of time for significant signal events such as state changes due to output transitions. As the complexities of time dependent signal sequences require, such as in the present analysis, state tables are used to define the digital signal levels and voltage transition events. The following state table describes the initial conditions at time t0, where counter output pins C6, C7 and C11 are not asserted, when the initialization pulse at the CLR pin of FF2 and the PR pin of FF3 establishes the initial conditions of the Flip-Flop array 100.

TABLE III

State Table Of Initialization Conditions At The Initial Counter Reset

Time t0: SW = 1 or SW = 0; [C11, C7, C6] = [0 0 0]

| | Q | QN | D | CLK | PR | CLR |
|---|---|---|---|---|---|---|
| FF1 | 1 | X | 0 | 0 | 0 | X |
| FF2 | 0 | 1 | 1 | 0 | X | |
| FF3 | X | 0 | SW | 0 | | X |

From Table III, it can be seen that at time t0, when the counter output pins C11, C7 and C6 are at a null output, the inputs to FF1, FF2 and FF3 are specified as: 0 or 1, X (don't care) conditions, or a symbol which represents a pulse with a transitioning rising edge and a falling edge. In Table III, there is a tether switch input (SW) which depends on the position of the tether switch 180. At initialization, the switch can be in either position for the same changes of state to occur.

The D-input to FF3 is dependent on the position of the tether switch 180. The tether switch 180 can be in the CLOSED position, indicating the tether mode, in which case the input (SW) at D-input to FF3 would be 0. If the tether switch 180 is in the OPEN position, the circuit is in the motion detection mode.

In Table III, the initialization pulse (-_-) can be observed urging a momentary negative assertion at the CLR pin of FF2 and the PR pin of FF3. The initialization pulse resets the Q-output of FF2 with a 0 and sets the Q-output of FF3 with a 1.

The next time interval, where the input to the Flip-Flop array 100 changes is at time t1. At time t1, the output state of the Flip-Flop array 100 does not change. Even though the counter input C6 changes from 0 to 1, the output state of the Flip-Flop array 100 is unaffected. The counter output C6 motions to clock the D-input of FF1 to the Q-output of FF1, but this motion is vetoed by the overriding assertion on the preset control input to FF1. Therefore, the state of FF1 does not change at time t1. The conditions at time t1 can be seen in the following table:

TABLE IV

Conditions At Time t1 Where C6 Is Asserted

Time t1: SW = 1 or SW = 0; [C11, C7, C6] = [0 0 1]

| | Q | QN | D | CLK | PR | CLR |
|---|---|---|---|---|---|---|
| FF1 | 1 | X | 0 | 0→1 | 0 | X |
| FF2 | 0 | 1 | 1 | 0 | X | 1 |
| FF3 | X | 0 | SW | 0 | 1 | X |

In the next time interval, at time t2, the output of the Flip-Flop array 100 changes. The output change is due to the counter output C7, which clocks FF2.

The D-input to FF2 is clocked to the Q-output. Since the previous state of the Q-output of FF2 was 0, and the D-input of FF2 is set to 1, the present state of the Q-output of FF2 is 1. In addition, the QNOT-output of FF2 changes state from 1 to 0, the logical inverse of the Q-output. The following tables describe the conditions as the Flip-Flop array 100 receives the 0 to 1 transition of the counter output C7 at time t2:

TABLE V

The Assertion Of C7 At Time t2 In The Tether Mode

Time t2: SW = 0; [C11, C7, C6] = [0 1 0]

| | Q | QN | D | CLK | PR | CLR |
|---|---|---|---|---|---|---|
| FF1 | 1 | X | 0 | 0 | 0→1 | X |
| FF2 | 0→1 | 1→0 | 1 | 0→1 | X | 1 |
| FF3 | X | 0→1 | 0 | 0→1 | 1 | X |

TABLE VI

The Assertion Of C7 At Time t2 In The Motion Detect Mode

Time t2: SW = 1; [C11, C7, C6] = [0 1 0]

| | Q | QN | D | CLK | PR | CLR |
|---|---|---|---|---|---|---|
| FF1 | 1 | X | 0 | 0 | 0→1 | X |
| FF2 | 0→1 | 1→0 | 1 | 0→1 | X | 1 |
| FF3 | X | 0 | 1 | 0→1 | 1 | X |

The state changes of the Q-output and the QNOT-output, at time t2 has several effects. First, the preset of FF1 is no longer asserted. Second, the clock of FF3 is changed from 0 to 1 which causes the QNOT-output of FF3 to change from 0 to 1 when the system is in the tether mode (Table V only). Third, the QNOT-output from 1 to 0 of FF2 is impressed on the chirp input AI-2 of the sounder logic 150 which detects the transition to trigger a chirp sound. Fourth, the motion sensor feedback channel MSFB1 is changed from 0 to 1. At the completion of the signal events at time t2, the system is considered in the alarm ready state. At the alarm ready state, the Flip-Flop array 100 is considered to be in a stable state. In fact, the Flip-Flop array 100 is in a stable waiting state.

The QNOT-output of FF3 is a branch line which has two paths: first, it has a feedback to the second motion sensor feedback channel MSFB2; second, the Q-output of FF3 provides an input to the 1-condition input AI-3, which is at the input to the sounder logic 150.

Up to this point, the state changes have not been dependent on the tether switch position SW. There are two possibilities for the tether switch position SW at initialization. In the first case, the switch position SW is assumed to be 0 at initialization, signifying the tether mode is in effect (realized as a change at time t2, see Table V). For the tether switch position SW to be 0, in the tether mode, the switch is in the closed position. In the second case, the tether switch SW1 is assumed to be 1 at initialization signifying the motion sensor mode is in effect (at time t2, see FIG. VI). The tether switch position is open when the motion sensor mode is in effect.

The transition of the system, to trigger the alarm in the tether mode, after the alarm ready of time t2, is summarized in the following state table:

TABLE VII

| Alarm Ready And Transition Of Tether Switch While In Tether Mode | | | | | | |
|---|---|---|---|---|---|---|
| Time t3: SW = 0→1: [C11, C7, C6] = [0 0 0] | | | | | | |
| | Q | QN | D | CLK | PR | CLR |
| FF1 | 1 | X | 0 | 0 | 1 | X |
| FF2 | 1 | 0 | 1 | 0 | X | 1 |
| FF3 | X | 1 | 0→1 | 0 | 1 | X |

In Table VII, it can be seen that as the D-input to FF3 transitions from 0 to 1 at time t3, the inputs to the sounder logic 150 at the 1 condition input AI-3 and the switch condition input AI-4 will be 1 and 1. This is because if the tether switch position SW is 0, at time t2 there is a clocked 1 at the QNOT-output of FF3.

When the switch becomes open in the alarm ready state tether mode, where the switch can become open resulting from the tether being pulled out during operation, the D-input to FF3, which is wired to the switch condition input AI-4 of the sounder logic 150, changes to 1. The 1 at the QNOT-output of FF3 is fed directly to the 1-condition input AI-3 to the sounder logic 150. The second input to the tether NAND gate N2, at the switch condition input AI-4, becomes 1 also due to the switch being opened. This 1 and 1 at the 1-condition input AI-3 and the switch condition input AI-4 causes the tether NAND gate N2 to drop, which drops the voltage at the Schmitt NAND gate SN3, also in the sounder logic 150 which triggers the sound alarm.

In summary, it is the combination of the 1 input resulting from the OPEN condition of tether switch 180, and the 1 input from the QNOT-output of FF3, introduced to the AI-4 and AI-3 inputs to the sounder logic 150, which causes the alarm to sound.

Now, in consideration of the second possibility, that the tether switch 180 is set to 1 at initialization, the system is in the motion detector mode. In the motion detector mode, at time t2 there occurs a clocked 0 at the QNOT-output of FF3. Since the tether switch position SW providing the D-input to FF3 is set at 1, there is no state change upon clocking the 1 at the D-input to the QNOT-output of FF3, because the initial state was preset to 0 at the initialization. Therefore, at time t2 in the motion detector mode, the channel MSFB2 remains at a 0 potential. It is important for the channel MSFB2 to be 0 because it provides a ground for the potential at channel MSFB1, at the opposite side of the motion sensor.

The effect of the change in state of the channel MSFB1 at time t2, is to provide the reset logic 120 with a signal that, in effect, holds the reset signal at pin R of the counter at 1, as long as the motion sense 140 is held open circuit. Should the motion sensor 140 start conducting between the channel MSFB1 and channel MSFB2, the majority of charges are diverted through the motion sense 140 to be grounded at the QNOT-output of FF3.

The impact of the conduction of the motion sensor 140, would represent an alteration in the position of the motion sensor 140. The voltage level of the motion sense 140 input to the pulse capture network 130 would then drop, by virtue of the two resistors in the motion sensor 140 which act as a voltage divider. The value of the resistor joined to MSFB1 is much greater than the value of the other resistor which sets the voltage at the tap output of the motion sense which is input to the pulse capture network 130. The dropped voltage proceeds through the pulse capture network 130 and is fed to the reset logic 120, which releases the reset signal at pin R of the counter 110. The release of the reset signal at pin R of the counter 110 causes the count to start along the counter output pins C6, C7 and C11. The alarm ready state, defined at a time t3 while the motion sensor 140 could detect motion and trigger the counter, is described in the following table:

TABLE VIII

| Alarm Ready In The Motion Detect Mode | | | | | | |
|---|---|---|---|---|---|---|
| Time t3: SW = 1: [C11, C7, C6] = [0 0 0] | | | | | | |
| | Q | QN | D | CLK | PR | CLR |
| FF1 | 1 | X | 0 | 0 | 1 | X |
| FF2 | 1 | 0 | 1 | 0 | X | 1 |
| FF3 | X | 1 | 1 | 1 | 1 | X |

The state of the Flip-Flop array 100 is defined at time t3, as in the alarm ready state, where the counter holds all counter outputs (C6, C7 and C11) to 0. The alarm system is therefore in an alarm ready state, waiting for the reset logic to release the reset assertion to the counter 110. At the time t3, all of the inputs to the Flip-Flop array 100 from the counter output pins C6, C7 and C11, are 0.

To elaborate further, in the alarm ready state, subsequent to time t3, the motion sensor 140 could receive a stimulation which could cause conduction between channel MSFB1 and channel MSFB2. The conduction of the motion sensor 140 quickly drops the voltage at the output of the motion sensor, which inputs to the pulse capture network 130 which provides a steady path to the reset logic 120. The reset logic 120 has another input which is tied to the reset logic feedback (RLFB). The RLFB is at the level of the Q-output of FF1 which at the present state of time t3 is 1.

While the motion sensor 140 is conducting, there is a 1 and 0 input at the reset logic 120 which raises the internal Schmitt NAND gate SN2 output voltage level sharply (the prior voltage output of the internal Schmitt NAND gate SN2 was 0, with a 1 and 1 input). The output of a 1 from the Schmitt NAND gate SN2 is introduced to the reset NAND gate N1 which is wired as an inverter (the other input is a sustained 1), causing the output of the reset logic 120 to change from its previous output from 1 to 0. In this manner, the reset signal at pin R of counter 110 is released.

In the time before the next state at time t4, the orientation of the motion sensor 140 could be corrected to an open circuit, nonconductive attitude. The correction of the motion sensor 140, in accordance with the RC time constant response of the pulse capture network 130, could raise the voltage at the reset logic 120. The pulse capture network 130 tends to remove erratic high frequency components from the motion sensor 140, making the output signal of the motion sensor 140 more reliable.

Raising the voltage at input to the reset logic 120 causes the two inputs to the Schmitt NAND gate SN2 in the reset logic to be 1, which results in a 0 output submitted to the reset NAND gate N1 wired as an inverter, which again asserts the reset signal at pin R of the counter 110 with a 1. Resetting the counter 110 halts the count to time t4, which is when the first signal count would occur, where the counter output C6 would be asserted at the clock of FF1.

Assuming there is no reprieve because the multiple events occurred, the counter 110 proceeds until time t4 occurs. The counter output pin C6 clocks the 0 at the D-input of FF1 to the Q-output. The Q-output of FF1 changes state from 1 to 0. The result of the Q-output of FF1 changing to 0 is the assertion of the alarm on input AI-1 to the sounder logic 150. Another result of the Q-output of FF1 transition from 1 to 0 is in an impressed signal change on the RLFB channel.

The RLFB channel's 1 to 0 transition drops the feedback input to the reset logic 120 at the Schmitt NAND gate SN2. The Schmitt NAND gate SN2 has an output of 1 if either of the inputs are 0. Therefore the Schmitt NAND gate SN2 has an output of 1. The feedback channel RLFB therefore locks the alarm condition. This is because, even in the event of the pulse capture network 130 input to the reset logic 120 becoming 1 due to a correction of the motion sensor 140 orientation, the 0 on the feedback channel RLFB keeps the Schmitt NAND gate SN2 at an output of 1. The output of 1 of the Schmitt NAND gate SN2 in the reset logic 120 is inverted at the reset NAND gate N1, so that the counter 110 could not be reset in the time interval when the counter output pin C6 triggers the alarm at time t4. The conditions for the alarm triggered are summarized in the following table:

TABLE IX

| Alarm Ready And Detection Of Motion Sensor While In Motion Detect Mode | | | | | | |
|---|---|---|---|---|---|---|
| Time t4: SW = 1; [C11, C7, C6] = [0 0 1] | | | | | | |
| | Q | QN | D | CLK | PR | CLR |
| FF1 | 1→0 | X | 0 | 0→1 | 1 | X |
| FF2 | 1 | 0 | 1 | 0 | X | 1 |
| FF3 | X | 0 | 1 | 1 | 1 | X |

At time t4, to summarize, the Q-output of FF1 has experienced a transition from 1 to 0, caused by the sustained conduction of the motion sensor 140 over a time interval bounded by the counter output C6. The 0 at the Q-output of FF1 is introduced to the alarm-on input AI-1 of the sounder logic, causing an alarm sound.

At time t5, defined by the counter output assertion C7, which clocks the 1 D-input of FF2 to the Q-output of FF2, causes no state change, because the Q-output of FF2 is already at 1. The state conditions at time t5 is defined in the following table:

TABLE X

| The Count Continues After Alarm Is Triggered | | | | | | |
|---|---|---|---|---|---|---|
| Time t5: SW = 1; [C11, C7, C6] = [0 1 0] | | | | | | |
| | Q | QN | D | CLK | PR | CLR |
| FF1 | 0 | X | 0 | 0 | 1 | X |
| FF2 | 1 | 0 | 1 | 0→1 | X | 1 |
| FF3 | X | 0 | 1 | 1 | 1 | X |

Referring to Table XI, at time t6, defined by the counter output assertion of C7 and C6 simultaneously, the 0 D-input to FF1 is clocked again, to the output, which again, causes no change of state because the output is already 0.

TABLE XI

| The Count Continues | | | | | | |
|---|---|---|---|---|---|---|
| Time t6: SW = 1; [C11, C7, C6] = [0 1 1] | | | | | | |
| | Q | QN | D | CLK | PR | CLR |
| FF1 | 0 | X | 0 | 0→1 | 1 | X |
| FF2 | 1 | 0 | 1 | 0→1 | X | 1 |
| FF3 | X | 0 | 1 | 1 | 1 | X |

At time t7, the D-input to FF1 changes from 0 to 1 due to the counter output assertion C11. The output of FF1 cannot change until the D-input to FF1 is clocked through, which occurs at time t8.

TABLE XII

| The Count Continues And After 2 Minutes Proceeding The Change In State | | | | | | |
|---|---|---|---|---|---|---|
| Time t7: SW = 1; [C11, C7, C6] = [1 0 0] | | | | | | |
| | Q | QN | D | CLK | PR | CLR |
| FF1 | 0 | X | 0→1 | 0 | 1 | X |
| FF2 | 1 | 0 | 1 | 0 | X | 1 |
| FF3 | X | 0 | 1 | 1 | 1 | X |

At time t8, there is a change in the output state of the Flip-Flop array 100. The D-input of FF1, which is held at 1, is clocked through by the assertion of counter output C6. The 1 appears at the Q-output of FF1 which releases the assertion of the sound alarm at the alarm-on input of the sounder logic 150. In the previous state, it was the 0 Q-output of FF1 which caused the alarm to sound. The 1 at the Q-output of FF1 not only shuts the alarm, but it whips a transitioning 0 to 1 signal defined at the leading edge of a step voltage on the channel RLFB. The transition at time t8 is defined in the following table.

TABLE XIII

| The Approximately 2 Minutes Reset Conditions | | | | | | |
|---|---|---|---|---|---|---|
| Time t8: SW = 1; [C11, C7, C6] = [1 0 1] | | | | | | |
| | Q | QN | D | CLK | PR | CLR |
| FF1 | 0→1 | X | 1 | 0→1 | 1 | X |
| FF2 | 1 | 0 | 1 | 0 | X | 1 |
| FF3 | X | 0 | 1 | 1 | 1 | X |

The rapidly advancing step function approaches the reset logic along the channel RLFB where it traverses the differentiating RC network which is input to the Schmitt NAND gate SN2 in the reset logic 120. The traversing voltage of the step function, in conjunction with the 1 at the DC level of the RLFB channel, provides an effective 1 and 1 input to the Schmitt NAND gate, dropping the output of the Schmitt NAND gate, which is inverted by the reset NAND gate, which becomes a 1 at the output of the reset logic 120 to assert the reset signal at pin R to the counter 110. The reset signal at pin R causes the counter outputs C11, C7 and C6 to become held at 0, constituting a return to an alarm ready state at time t3 which could be triggered again by movement of the motion sensor.

Referring to FIGS. 2 and 4, there is the sounder logic 150 output, connected to the sounder driver 160 which is configured to stimulate the piezoelectric sound generator 170.

In the sound driver 160, the NAND gate N3 is constantly receiving the 4 KHz frequency signal (with the injected error to make the warbling sound) at input 12. The NAND gate N3 will not allow the 4 KHz frequency to pass unless it is enabled by a 1 at the other input I1 to NAND gate N3 which is supplied by the sounder logic 150 output of on/off.

In an alternative embodiment, the present circuit invention could be activated and deactivated by means of a hand held device 60 as shown in FIG. 1. In addition, a hand held device could alert the user remotely of an alarm condition. To implement these activation, deactivation and signaling functions, the hand held device and the device mounted on the flat sporting equipment would require a transmitter, a receiver and a signal processing and switching means. There are several technologies which support the digital signal processing, of transmitted and received signals. The present circuit embodiment could easily be adapted to a digital signal processing organization.

An alternative embodiment of the present invention could be used to transmit and receive the switch conditions and alarm conditions of the circuit. This modification would include: a switch position transmitter, where three of the switch positions are set to transmit digital code signals, converted to frequencies of an active oscillator circuit along a signal propagating means over frequencies of the wireless channel to stimulate active tank circuits tuned to the frequency bands of transmission.

The active tank circuits could receive the signals at mounted alarm system, which are received and shifted by shift registers to be compared to a known code. The comparison of the transmission signal to the known code could retain the identity of the individual transmitter and receiver combination, so that the result of a match could (depending on the known code received): first, provide an initialization pulse; second, disable the alarm; and third, enable the alarm. In addition, there would be a remote alerting signal received at the hand held device which involves similar signal processing.

The transmitter and receiver could be linked through a digital signal processing channel where the digital codes are sent along a wireless channel then converted back to digital codes where they are received. The wireless channel range could be extended so that a person who is using the flat sporting equipment could be alerted by another party. The wireless channel could be tuned to the operating frequencies of a repeater network. And the wireless channel could be tuned to the operating frequency of a cellular network so that a user could activate and deactivate the dual-mode alarm apparatus by means of telephone transmission which could provide the additional benefit of a beeper type alerting to the skier.

Defined in detail, the present invention is a dual-mode alarm apparatus for a ski having a generally flat narrow upper surface mounted with a ski binding for receiving a skier's ski boot, the dual-mode alarm apparatus comprising: (a) an independent and unitary housing having an aerodynamic exterior configuration; (b) said housing retaining an auditory alarm means, a visual alarm means, a power means, a power switch, a tether switch and a motion sensor, all electrically connected with an electronic alarm circuitry contained within said housing; (c) said auditory alarm means being able to produce an audible alarm which can be heard from outside of said housing; (d) said visual alarm means being able to produce a visible alarm which can be seen from outside of said housing; (e) said power switch being switchable from outside of said housing by a key means, such that said alarm circuitry is electrically energized when said power switch is switched to an on position, and said alarm circuitry is electrically de-energized when said power switch is switched to an off position; (f) said tether switch having a tether aperture accessible from outside of said housing for accommodating a tether means, such that the insertion of the tether means causes said tether switch to be in a closed status and the removal of the tether means causes said tether switch to be in an open status; (g) means for mounting said housing onto said generally flat narrow upper surface of said ski at a location adjacent to said ski binding; (h) means for linking said tether means with said ski binding such that the separation of said skier's ski boot from said ski binding will cause said tether means to be removed from said tether aperture of said tether switch; (i) said alarm circuitry including a visual alarm driver for operating said visual alarm means such that when said power switch is switched to said on position, said visual alarm means will produce said visible alarm; (j) said alarm circuitry further including an initialization circuit and a flip-flop array for setting said alarm apparatus in one of two operating modes including a tether detect mode and a motion detect mode, such that when said tether switch is in said close status, switching said power switch to said on position will set said alarm apparatus in the tether detect mode, and when said tether switch is in said open status, switching said power switch to said on position will set said alarm apparatus in the motion detect mode; (k) said alarm circuitry further including a logic gate array connected to said flip-flop array and said tether switch and being operable in both said two operating modes; (l) said alarm circuitry further including an auditory alarm driver connected to said logic gate array for operating said auditory alarm means, such that said auditory alarm driver will cause said auditory alarm means to produce said audible alarm upon receiving a desired logic output from said logic gate array; (m) said logic gate array including logic gate means which will produce said desired logic output, when said alarm apparatus is in said tether detect mode and the status of said tether switch is changed from said closed status to said open status; (n) said alarm circuitry further including a counter means interconnected between said motion sensor and said flip-flop array for causing said flip-flop array to produce a desired flip-flop output which in turn will cause said logic gate array to produce said desired logic output, when said alarm apparatus is in said motion detect mode and said motion sensor detects movement of said ski; (o) said flip-flop array being able to not produce said desired flip-flop output as said motion sensor detects movement of said ski, when said alarm apparatus is in said tether detect mode; and (p) said logic gate array being able to not produce said desired logic output as said tether means is removed from said tether aperture of said tether switch, when said alarm apparatus is in said motion detect mode; (q) whereby when said skier is going to use said ski for skiing, said skier can first insert said tether means into said tether aperture of said tether switch and then turn said power switch to said on position to set said alarm apparatus in said tether detect mode, so that said audible alarm will be produced upon the separation of said ski binding and said skier's ski boot for assisting said skier to locate said ski, and when said skier is going to leave said ski unattended, said skier can first remove said tether means from said tether aperture of said tether switch and then turn said power switch to said on position to set said alarm apparatus in said motion detect mode, so that said audible alarm will be produced upon the unwanted movement of said ski for alerting said skier to guard said ski.

Defined broadly, the present invention is a dual-mode alarm apparatus for a snow-sports equipment having a generally flat upper surface for receiving a user's snow-sports boot, the dual-mode alarm apparatus comprising, (a) an independent housing having an aerodynamic exterior configuration; (b) said housing retaining an auditory alarm means, a visual alarm means, a power means, a power switch, a tether switch and a motion sensor, all electrically connected with an electronic alarm circuitry contained within said housing; (c) said auditory alarm means being able to produce an audible alarm which can be heard from outside of said housing; (d) said visual alarm means being able to produce a visible alarm which can be seen from outside of said housing; (e) said power switch being switchable from outside of said housing, such that said alarm circuitry is electrically energized when said power switch is switched to an on position, and said alarm circuitry is electrically de-energized when said power switch is switched to an off position; (f) said tether switch being able to be triggered between a closed status and an open status; (g) means for mounting said housing onto said generally flat upper surface of said snow-sports equipment; (h) means for linking said tether switch with said user's snow-sports boots such that the separation of said skier's ski boot from said snow-sports equipment will cause said tether switch to change from said closed status to said open status; (i) said alarm circuitry including a visual alarm driver for operating said visual alarm means such that when said power switch is switched to said on position, said visual alarm means will produce said visible alarm; (j) said alarm circuitry further including an initialization circuit and a flip-flop array for setting said alarm apparatus in one of two operating modes including a tether detect mode and a motion detect mode, such that when said tether switch is in said closed status, switching said power switch to said on position will set said alarm apparatus in the tether detect mode, and when said tether switch is in said open status, switching said power switch to said on position will set said alarm apparatus in the motion detect mode; (k) said alarm circuitry further including a logic gate array connected to said flip-flop array and said tether switch and being operable in both said two operating modes; (l) said alarm circuitry further including an auditory alarm driver connected to said logic gate array for operating said auditory alarm means, such that said auditory alarm driver will cause said auditory alarm means to produce said audible alarm upon receiving a desired logic output from said logic gate array; (m) said logic gate array being able to produce said desired logic output when said alarm apparatus is in said tether detect mode and the status of said tether switch is changed from said closed status to said open status; (n) said alarm circuitry further including a counter means interconnected between said motion sensor and said flip-flop array for causing said flip-flop array to produce a desired flip-flop output which in turn will cause said logic gate array to produce said desired logic output, when said alarm apparatus is in said motion detect mode and said motion sensor detects movement of said snow-sports equipment; (o) said flip-flop array will not produce said desired flip-flop output as said motion sensor detects movement of said snow-sports equipment, when said alarm apparatus is in said tether detect mode; and (p) said logic gate array will not produce said desired flip-flop output as said tether switch is changed to said open status, when said alarm apparatus is in said motion detect mode; (q) whereby when said user is going to use said snow-sports equipment, said user can first set said tether switch to said closed status and then turn said power switch to said on position to set said alarm apparatus in said tether detect mode, so that said audible alarm will be produced upon the separation of said user's snow-sports boot and said snow-sports equipment for assisting said user to locate said snow-sports equipment, and when said user is going to leave said snow-sports equipment unattended, said user can first set said tether switch to said open status and then turn said power switch to said on position to set said alarm apparatus in said motion detect mode, so that said audible alarm will be produced upon the unwanted movement of said snow-sports equipment for alerting said user to guard said snow-sports equipment.

Defined more broadly, the present invention is a dual-mode alarm apparatus for a sports equipment, comprising: (a) a housing for retaining an auditory alarm means, a visual alarm means, a power means, a power switch, a separation switch and a motion sensor, all electrically connected with an electronic alarm circuitry contained within said housing; (b) said auditory alarm means being able to produce an audible alarm which can be heard from outside of said housing; (c) said visual alarm means being able to produce a visible alarm which can be seen from outside of said housing; (d) said power switch being switchable from outside of said housing between an on position for electrically energizing said alarm circuitry and an off position for electrically deenergizing said alarm circuitry; (e) said separation switch being able to be set to a closed status by said user, and being able to be triggered to an open status upon separation of said sport equipment and said user; (f) means for mounting said housing to said sports equipment; (g) said alarm circuitry including a visual alarm driver for operating said visual alarm means such that when said power switch is switched to said on position, said visual alarm means will produce said visible alarm; (h) said alarm circuitry further including an initialization circuit and a flip-flop array for setting said alarm apparatus in one of two operating modes including a separation detect mode and a motion detect mode, such that when said separation switch is in said closed status, switching said power switch to said on position will set said alarm apparatus in the separation detect mode, and when said separation switch is in said open status, switching said power switch to said on position will set said alarm apparatus in the motion detect mode; (i) said alarm circuitry further including a logic gate array connected to said flip-flop array and said separation switch, and an auditory alarm driver connected to the logic gate array for operating said auditory alarm means, such that said auditory alarm driver will cause said auditory alarm means to produce said audible alarm upon receiving a desired logic output from the logic gate array; (j) said logic gate array being able to produce said desired logic output when said alarm apparatus is in said separation detect mode and the status of said separation switch is triggered from said closed status to said open status; (k) said flip-flop array being able to produce a desired flip-flop output, which in turn causes said logic gate array to produce said desired logic output, when said alarm apparatus is in said motion detect mode and said motion sensor detects movement of said sports equipment; (l) said flip-flop array will not produce said desired flip-flop output as said motion sensor detects movement of said sports equipment, when said alarm apparatus is in said separation detect mode; and (m) said logic gate array will not produce said desired logic output as said separation switch is changed to said open status, when said alarm apparatus is in said motion detect mode; (n) whereby when said user is going to use said sports equipment, said user can first set said separation switch to said closed status and then turn said power switch to said on position to set said alarm apparatus in said separation detect mode, so that said audible alarm will be produced upon the separation of said sports equipment and said user for assisting said user to locate said sports equipment, and when said user is going to leave said sports equipment unattended, said user can first set said separation switch to said open status and then turn said power switch to said on position to set said alarm apparatus in said motion detect mode, so that said audible alarm will be produced upon the unwanted movement of said sports equipment for alerting said user to guard said sports equipment.

Of course the present invention is not intended to be restricted to any particular form of arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A dual-mode alarm apparatus for a ski having a generally flat narrow upper surface mounted with a ski binding for receiving a skier's ski boot, the dual-mode alarm apparatus comprising:

a. a unitary housing having an aerodynamic exterior configuration;

b. said housing retaining an auditory alarm means, a visual alarm means, a power means, a power switch, a tether switch and a motion sensor, all electrically connected with electronic alarm circuitry contained within said housing;

c. said auditory alarm means being able to produce an audible alarm which can be heard from outside of said housing;

d. said visual alarm means being able to produce a visible alarm which can be seen from outside of said housing;

e. said power switch being switchable from outside of said housing by a key means, such that said alarm circuitry is electrically energized when said power switch is switched to an on position, and said alarm circuitry is electrically de-energized when said power switch is switched to an off position;

f. said tether switch having a tether aperture accessible from outside of said housing for accommodating a tether means, such that the insertion of the tether means causes said tether switch to be in a closed status and the removal of the tether means causes said tether switch to be in an open status;

g. means for mounting said housing onto said generally flat narrow upper surface of said ski at a location adjacent to said ski binding;

h. means for linking said tether means with said skier's ski boot such that the separation of said skier's ski boot from said ski binding will cause said tether means to be removed from said tether aperture of said tether switch;

i. said alarm circuitry including a visual alarm driver for operating said visual alarm means such that when said power switch is switched to said on position, said visual alarm means will produce said visible alarm;

j. said alarm circuitry further including an initialization circuit and a flip-flop array for setting said alarm apparatus in one of two operating modes including a tether detect mode and a motion detect mode, such that when said tether switch is in said closed status, switching said power switch to said on position will set said alarm apparatus in the tether detect mode, and when said tether switch is in said open status, switching said power switch to said on position will set said alarm apparatus in the motion detect mode;

k. said alarm circuitry further including a logic gate array connected to said flip-flop array and said tether switch and being operable in both said two operating modes;

l. said alarm circuitry further including an auditory alarm driver connected to said logic gate array for operating said auditory alarm means, such that said auditory alarm driver will cause said auditory alarm means to produce said audible alarm upon receiving a desired logic output from said logic gate array;

m. said logic gate array including logic gate means which will produce said desired logic output, when said alarm apparatus is in said tether detect mode and the status of said tether switch is changed from said closed status to said open status;

n. said alarm circuitry further including a counter means interconnected between said motion sensor and said flip-flop array for causing said flip-flop array to produce a desired flip-flop output which in turn will cause said logic gate array to produce said desired logic output, when said alarm apparatus is in said motion detect mode and said motion sensor detects movement of said ski;

o. said flip-flop array will not produce said desired flip-flop output as said motion sensor detects movement of said ski, when said alarm apparatus is in said tether detect mode; and p. said logic gate array will not produce said desired logic output as said tether means is removed from said tether aperture of said tether switch, when said alarm apparatus is in said motion detect mode;

q. whereby when said skier is going to use said ski for skiing, said skier can first insert said tether means into said tether aperture of said tether switch and then turn said power switch to said on position to set said alarm apparatus in said tether detect mode, so that said audible alarm will be produced upon the separation of said ski binding and said skier's ski boot for assisting said skier to locate said ski, and when said skier is going to leave said ski unattended, said skier can first remove said tether means from said tether aperture of said tether switch and then turn said power switch to said on position to set said alarm apparatus in said motion detect mode, so that said audible alarm will be produced upon the unwanted movement of said ski for alerting said skier to guard said ski.

2. The invention in accordance with claim 1 where said auditory alarm means is an electronic loudspeaker.

3. The invention in accordance with claim 1 where said visual alarm means is a light emitting diode (LED).

4. The invention in accordance with claim 1 where said power means includes at least one direct current (DC) battery.

5. The invention in accordance with claim 4 wherein said at least one battery means is retain in a battery compartment within said housing, the battery compartment having a door, and said alarm circuitry further comprises a battery-door tamper switch which is connected to said flip-flop array, such that when said power switch is switched to said on position, said battery door tampering switch will cause said flip-flop array to produce said desired flip-flop output if the battery compartment door is tampered with, which will ultimately result in the production of said audible alarm.

6. The invention in accordance with claim 1 where said motion sensor is a mercury switch motion sensor.

7. The invention in accordance with claim 1 wherein said means for linking said tether means with said skier's ski boot includes a flexible cord.

8. The invention in accordance with claim 1 wherein said visual alarm driver of said alarm circuitry includes a NAND logic gate means.

9. The invention in accordance with claim 1 wherein said auditory alarm driver of said alarm circuitry includes a piezo-electric crystal means.

10. The invention in accordance with claim 1 wherein said initialization circuit of said alarm circuitry includes at least one Schmitt NAND logic gate means.

11. The invention in accordance with claim 1 wherein said flip-flop array of said alarm circuitry includes a multiplicity of D-type Flip-Flop means.

12. The invention in accordance with claim 1 wherein said logic gate means of said logic array of said alarm circuitry includes at least one Schmitt NAND logic gate means and at least one NAND logic gate means.

13. The invention in accordance with claim 1 wherein said alarm circuitry further comprises a pulse capture network circuit interconnected between said motion sensor and said counter means for preventing a false alarm produced by erratic signal fluctuations.

14. The invention in accordance with claim 1 wherein said alarm circuitry further comprises a frequency generator means for providing a multiplicity of working frequencies, including a first working frequency for said counter means, a second working frequency for said auditory alarm driver and a third working frequency for said visual alarm driver.

15. The invention in accordance with claim 1 wherein said mounting means comprises screw means.

16. The invention in accordance with claim 1 wherein said mounting means comprises adhesive means.

17. A dual-mode alarm apparatus for a snow-sports equipment having a generally flat upper surface for receiving a user's snow-sports boot, the dual-mode alarm apparatus comprising:

a. a housing having an aerodynamic exterior configuration;

b. said housing retaining an auditory alarm means, a visual alarm means, a power means, a power switch, a tether switch and a motion sensor, all electrically connected with electronic alarm circuitry contained within said housing;

c. said auditory alarm means being able to produce an audible alarm which can be heard from outside of said housing;

d. said visual alarm means being able to produce a visible alarm which can be seen from outside of said housing;

e. said power switch being switchable from outside of said housing, such that said alarm circuitry is electrically energized when said power switch is switched to an on position, and said alarm circuitry is electrically de-energized when said power switch is switched to an off position;

f. said tether switch being able to be triggered between a closed status and an open status;

g. means for mounting said housing onto said generally flat upper surface of said snow-sports equipment;

h. means for linking said tether switch with said user's snow-sports boots such that the separation of said user's boot from said snow-sports equipment will cause said tether switch to change from said closed status to said open status;

i. said alarm circuitry including a visual alarm driver for operating said visual alarm means such that when said power switch is switched to said on position, said visual alarm means will produce said visible alarm;

j. said alarm circuitry further including an initialization circuit and a flip-flop array for setting said alarm apparatus in one of two operating modes including a tether detect mode and a motion detect mode, such that when said tether switch is in said closed status, switching said power switch to said on position will set said alarm apparatus in the tether detect mode, and when said tether switch is in said open status, switching said power switch to said on position will set said alarm apparatus in the motion detect mode;

k. said alarm circuitry further including a logic gate array connected to said flip-flop array and said tether switch and being operable in both said two operating modes;

l. said alarm circuitry further including an auditory alarm driver connected to said logic gate array for operating said auditory alarm means, such that said auditory alarm driver will cause said auditory alarm means to produce said audible alarm upon receiving a desired logic output from said logic gate array;

m. said logic gate array being able to produce said desired logic output when said alarm apparatus is in said tether detect mode and the status of said tether switch is changed from said closed status to said open status;

n. said alarm circuitry further including a counter means interconnected between said motion sensor and said flip-flop array for causing said flip-flop array to produce a desired flip-flop output which in turn will cause said logic gate array to produce said desired logic output, when said alarm apparatus is in said motion detect mode and said motion sensor detects movement of said snow-sports equipment;

o. said flip-flop array will not produce said desired flip-flop output as said motion sensor detects movement of said snow-sports equipment, when said alarm apparatus is in said tether detect mode; and p. said logic gate array will not produce said desired logic output as said tether switch is changed to said open status, when said alarm apparatus is in said motion detect mode;

q. whereby when said user is going to use said snow-sports equipment, said user can first set said tether switch to said closed status and then turn said power switch to said on position to set said alarm apparatus in said tether detect mode, so that said audible alarm will be produced upon the separation of said user's snow-sports boot and said snow-sports equipment for assisting said user to locate said snow-sports equipment, and when said user is going to leave said snow-sports equipment unattended, said user can first set said tether switch to said open status and then turn said power switch to said on position to set said alarm apparatus in said motion detect mode, so that said audible alarm will be produced upon the unwanted movement of said snow-sports equipment for alerting said user to guard said snow-sports equipment.

18. The invention in accordance with claim 17 wherein said visual alarm driver of said alarm circuitry includes a NAND logic gate means.

19. The invention in accordance with claim 17 wherein said initialization circuit of said alarm circuitry includes at least one Schmitt NAND logic gate means.

20. The invention in accordance with claim 17 wherein said flip-flop array of said alarm circuitry includes at least one D-type Flip-Flop means.

21. The invention in accordance with claim 17 wherein said logic array of said alarm circuitry includes at least one Schmitt NAND logic gate means and at least one NAND logic gate means.

22. The invention in accordance with claim 17 wherein said alarm circuitry further comprises a pulse capture network circuit interconnected between said motion sensor and said counter means for preventing a false alarm produced by an erratic signal fluctuation.

23. The invention in accordance with claim 17 wherein said alarm circuitry further comprises a frequency generator means for providing a multiplicity of working frequencies, including a first working frequency for said counter means, a second working frequency for said auditory alarm driver and a third working frequency for said visual alarm driver.

24. The invention in accordance with claim 17 wherein said power means includes at least one battery means retained in a battery compartment within said housing, the battery compartment having a door, and said alarm circuitry further comprises a battery-door tamper switch which is connected to said flip-flop array, such that when said power switch is switched to said on position, said battery door tampering switch will cause said flip-flop array to produce said desired flip-flop output if the battery compartment door is tampered with, which will ultimately result in the production of said audible alarm.

25. The invention in accordance with claim 17 wherein said mounting means comprises screw means.

26. The invention in accordance with claim 17 wherein said mounting means comprises adhesive means.

27. A dual-mode alarm apparatus for a sports equipment, comprising:

a. a housing for retaining an auditory alarm means, a visual alarm means, a power means, a power switch, a separation switch and a motion sensor, all electrically connected with electronic alarm circuitry contained within said housing;

b. said auditory alarm means being able to produce an audible alarm which can be heard from outside of said housing;

c. said visual alarm means being able to produce a visible alarm which can be seen from outside of said housing;

d. said power switch being switchable from outside of said housing between an on position for electrically energizing said alarm circuitry and an off position for electrically de-energizing said alarm circuitry;

e. said separation switch being able to be set to a closed status by said user, and being able to be triggered to an open status upon separation of said sport equipment and said user;

f. means for mounting said housing to said sports equipment;

g. said alarm circuitry including a visual alarm driver for operating said visual alarm means such that when said power switch is switched to said on position, said visual alarm means will produce said visible alarm;

h. said alarm circuitry further including an initialization circuit and a flip-flop array for setting said alarm apparatus in one of two operating modes including a separation detect mode and a motion detect mode, such that when said separation switch is in said closed status, switching said power switch to said on position will set said alarm apparatus in the separation detect mode, and when said separation switch is in said open status, switching said power switch to said on position will set said alarm apparatus in the motion detect mode;

i. said alarm circuitry further including a logic gate array connected to said flip-flop array and said separation switch, and an auditory alarm driver connected to the logic gate array for operating said auditory alarm means, such that said auditory alarm driver will cause said auditory alarm means to produce said audible alarm upon receiving a desired logic output from the logic gate array;

j. said logic gate array being able to produce said desired logic output when said alarm apparatus is in said separation detect mode and the status of said separation switch is triggered from said closed status to said open status;

k. said flip-flop array being able to produce a desired flip-flop output, which in turn causes said logic gate array to produce said desired logic output, when said alarm apparatus is in said motion detect mode and said motion sensor detects movement of said sports equipment;

l. said flip-flop array will not produce said desired flip-flop output as said motion sensor detects movement of said sports equipment, when said alarm apparatus is in said separation detect mode; and m. said logic gate array will not produce said desired logic output as said separation switch is changed to said open status, when said alarm apparatus is in said motion detect mode;

n. whereby when said user is going to use said sports equipment, said user can first set said separation switch to said closed status and then turn said power switch to said on position to set said alarm apparatus in said separation detect mode, so that said audible alarm will be produced upon the separation of said sports equipment and said user for assisting said user to locate said sports equipment, and when said user is going to leave said sports equipment unattended, said user can first set said separation switch to said open status and then turn said power switch to said on position to set said alarm apparatus in said motion detect mode, so that said audible alarm will be produced upon the unwanted movement of said sports equipment for alerting said user to guard said sports equipment.

28. The invention in accordance with claim 27 wherein said initialization circuit of said alarm circuitry includes at least one Schmitt NAND logic gate means.

29. The invention in accordance with claim 27 wherein said flip-flop array of said alarm circuitry includes at least one D-type Flip-Flop means.

30. The invention in accordance with claim 27 wherein said logic array of said alarm circuitry includes at least one Schmitt NAND logic gate means and at least one NAND logic gate means.

31. The invention in accordance with claim 27 wherein said alarm circuitry further comprises a pulse capture network circuit interconnected between said motion sensor and said counter means for presenting a false alarm produced by erratic signal fluctuations.

32. The invention in accordance with claim 27 wherein said mounting means comprises screw means.

33. The invention in accordance with claim 27 wherein said mounting means comprises adhesive means.

34. A dual-mode alarm apparatus for a sports equipment, comprising:

a. a housing mounted to said sports equipment for retaining an alarm means, a separation sensor and a motion sensor, all electrically connected with electronic alarm circuitry which can be set in one of two operating modes including a separation detect mode and a motion detect mode;

b. in said separation detect mode, said alarm circuitry being able to activate said alarm means when said separation sensor detects separation of said sport equipment and said user, but not activate said alarm means even if said sport equipment is moving; and c. in said motion detect mode, said alarm circuitry being able to activate said alarm means when said motion sensor detects movement of said sport equipment, but not activate said alarm means even if said sport equipment is separated from said user;

n. whereby when said user is going to use said sports equipment, said user can set said alarm apparatus in said separation detect mode, so that said alarm means will be activated upon the separation of said sports equipment and said user for assisting said user to locate said sports equipment, and when said user is going to leave said sports equipment unattended, said user can set said alarm apparatus in said motion detect mode, so that said alarm means will be activated upon the unwanted movement of said sports equipment for alerting said user to guard said sports equipment.

35. The invention in accordance with claim 34 wherein said alarm apparatus further includes a power means for energizing said electronic circuitry and a power switch for switching on or off said alarm apparatus.

36. The invention in accordance with claim 34 wherein said electronic circuitry includes a power switch which can be switched on or off, an initialization circuit and a flip-flop array for setting said alarm apparatus in one of said two operating modes, such that when said sport equipment and said user are not separated, switching on said power switch will set said alarm apparatus in said separation detect mode, and when said sport equipment and said user are separated, switching said power switch to said on position will set said alarm apparatus in said motion detect mode.

37. The invention in accordance with claim 36 wherein said electronic circuitry further includes a logic gate array connected to said flip-flop array, and an alarm driver connected to the logic gate array for operating said alarm means, such that said alarm driver will cause said alarm means to produce an alarm signal upon receiving a desired logic output from the logic gate array.

* * * * *